US008281507B2

(12) United States Patent
Taylor et al.

(10) Patent No.: US 8,281,507 B2
(45) Date of Patent: Oct. 9, 2012

(54) THREE DIMENSIONAL ILLUMINATED GREETING CARDS

(75) Inventors: Anastasia Taylor, San Diego, CA (US); Allison Marsh, Ravenna, OH (US); Johnathan Talbot, Bay Village, OH (US); Tiger Qiao, Shanghai (CN); Jerry Guo, Shanghai (CN); Eva Jin, Shanghai (CN); David Sapp, North Ridgeville, OH (US); Seth Larson, Lakewood, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 13/090,552

(22) Filed: Apr. 20, 2011

(65) Prior Publication Data

US 2011/0258892 A1 Oct. 27, 2011

Related U.S. Application Data

(60) Provisional application No. 61/326,359, filed on Apr. 21, 2010.

(51) Int. Cl.

| | |
|---|---|
| ***G09F 1/00*** | (2006.01) |
| ***B65D 73/00*** | (2006.01) |
| ***B65D 85/20*** | (2006.01) |
| ***B65D 75/00*** | (2006.01) |
| ***B65D 5/10*** | (2006.01) |
| ***B42D 15/00*** | (2006.01) |

(52) U.S. Cl. ..... 40/124.02; 40/124.08; 206/463; 206/464; 206/784; 206/521; 206/446; 206/277; 229/122.21; 229/92.8; 229/117

(58) Field of Classification Search ..... 40/124.02, 40/124.08; 206/463, 464, 784, 521, 446, 206/277; 229/92.8, 117

See application file for complete search history.

(56) References Cited

U.S. PATENT DOCUMENTS

| | | | | |
|---|---|---|---|---|
| 930,108 | A * | 8/1909 | Walcutt | 446/148 |
| 4,209,824 | A | 6/1980 | Kaufman | |
| 4,286,399 | A | 9/1981 | Funahashi et al. | |
| 4,363,081 | A * | 12/1982 | Wilbur | 362/98 |
| 4,497,126 | A * | 2/1985 | Dejean | 40/124.02 |
| 4,559,583 | A | 12/1985 | Ku | |
| 5,293,706 | A * | 3/1994 | Wood | 40/124.08 |
| 2003/0192209 | A1 | 10/2003 | Yeh | |
| 2004/0205988 | A1 | 10/2004 | Kohler et al. | |
| 2005/0060919 | A1 | 3/2005 | Yu et al. | |
| 2005/0183297 | A1 | 8/2005 | Epstein | |
| 2007/0193080 | A1 * | 8/2007 | Hillman | 40/124.08 |

* cited by examiner

*Primary Examiner* — Tashiana Adams
*Assistant Examiner* — Syed A Islam
(74) *Attorney, Agent, or Firm* — James C. Scott; Roetzel & Andress

(57) ABSTRACT

A three-dimensional illuminated greeting card which combines a unique card construction having a 3D pop-out structure with one or more lights contained therein. The 3D pop-out structure forms an internal cavity in which illumination means and other electronic components are contained. One or more sides of the 3D structure are made of translucent or semi-translucent material, creating a screen that can be illuminated from behind by one or more miniature lights, such as LED lights. The light or lights may be connected to an integrated circuit chip that can be programmed with various lighting effects. The greeting card may optionally include other electronic components which are configured to play sound or music or perform other electronic effects.

8 Claims, 4 Drawing Sheets

THREE DIMENSIONAL ILLUMINATED GREETING CARDS

RELATED APPLICATIONS

This application claims priority to U.S. Provisional Patent Application Ser. No. 61/326,359, filed on Apr. 21, 2010, the entire contents of which are incorporated herein by reference.

FIELD OF THE INVENTION

The present invention is in the field of greeting cards, and more specifically to three dimensional greeting cards having illumination features.

BACKGROUND OF THE INVENTION

For many years traditional paper greeting cards have been widely used for celebratory occasions such as birthdays, graduations, weddings, and for other commercial purposes. More recently, the market has expanded with greeting cards that attempt to capture attention by means of particular designs or devices, and to add features and functions to standard paper cards to enhance the communicative and entertainment value of social and relational greetings. Mass production of digital electronics and devices has increased availability and reduced costs, but only a limited variety of cards with electronic features have been developed:

SUMMARY OF THE INVENTION

The present disclosure and related inventions provides novel greeting card constructions which also have electronic features such as lights which co-operate with the various card constructions and materials. A three dimensional illuminated greeting card including a greeting card body having two or more greeting card panels, a pop-out structure that is integral with the greeting card body, the pop-out structure operative to move between a first position which is folded flat between two greeting card panels and a second position which projects outward and forms a three-dimensional cavity between two greeting card panels, a light module contained within the pop-out structure, the light module comprising an integrated circuit, a power source and one or more LED lights, and a switch operative to control the illumination of the one or more LED lights. A portion of the pop-out structure is made of a translucent material.

DETAILED DESCRIPTION OF PREFERRED AND ALTERNATE EMBODIMENTS

The three-dimensional (3D) illuminated greeting cards of the present disclosure and related inventions combine a unique card construction having a 3D pop-out structure (hereinafter referred to as "3D structure" or "pop-out structure") with one or more illumination devices. The 3D structure forms an internal cavity in which the illumination means and other electronic components are contained. One or more sides of the 3D structure are made of acetate, tracing paper, or any other type of translucent or semi-transparent material to create a screen that can be illuminated from behind by one or more miniature lights, such as light emitting diode (LED) lights. The light or lights are connected to an integrated circuit (IC) chip that can be programmed with various lighting effects. The greeting card may optionally contain additional electronic components configured to play sound or music or perform other electronic effects.

Figure 3:
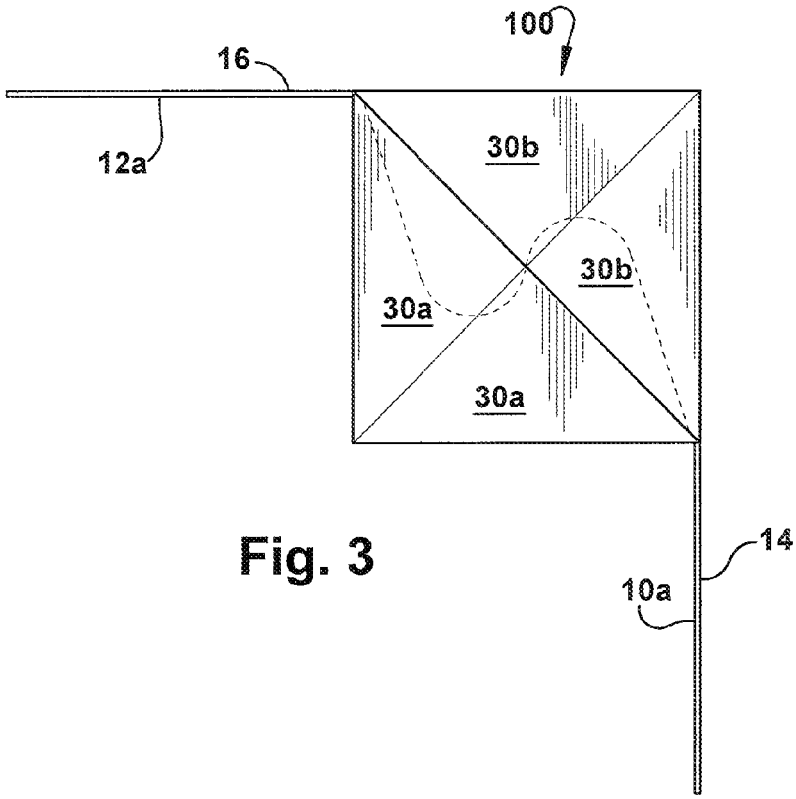
FIG. 3 is a top view of the 3D illuminated greeting card of FIG. 1, in an open position.
Figure 4:
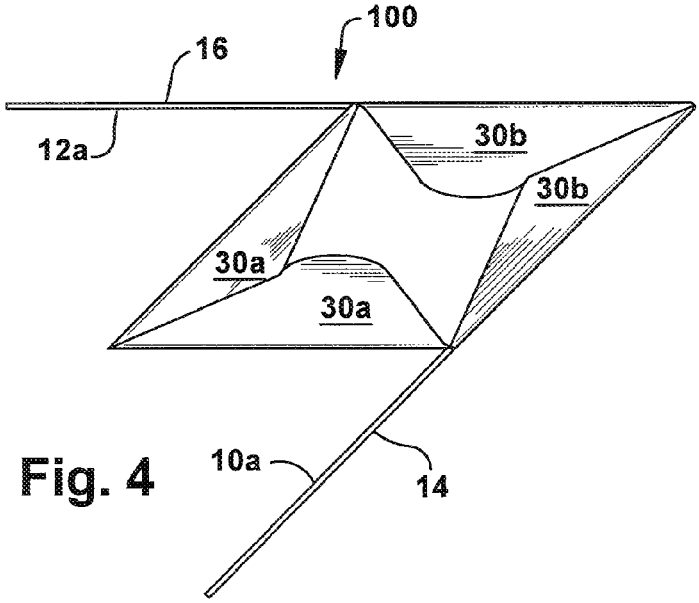
FIG. 4 is a top view of the 3D illuminated greeting card of FIG. 1, in a semi-open position.
Figure 5:
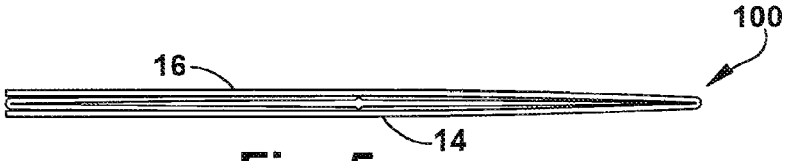
FIG. 5 is a top view of the 3D illuminated greeting card of FIG. 1, in a closed position.

The greeting card body or construct can take many different forms depending on the size and shape of the 3D structure. From a folded or closed position, each embodiment of the greeting card looks like a typical two panel single fold greeting card, as shown in FIG. 5. However, when the greeting card is opened, a 3D structure or enclosed cavity is constructed having illumination means contained therein, shown in FIGS. 3, 4. Various embodiments of the 3D structure and card construct are described herein, however, these embodiments are presented as examples only and are not in any way intended to limit the scope of the invention.

Figure 1:
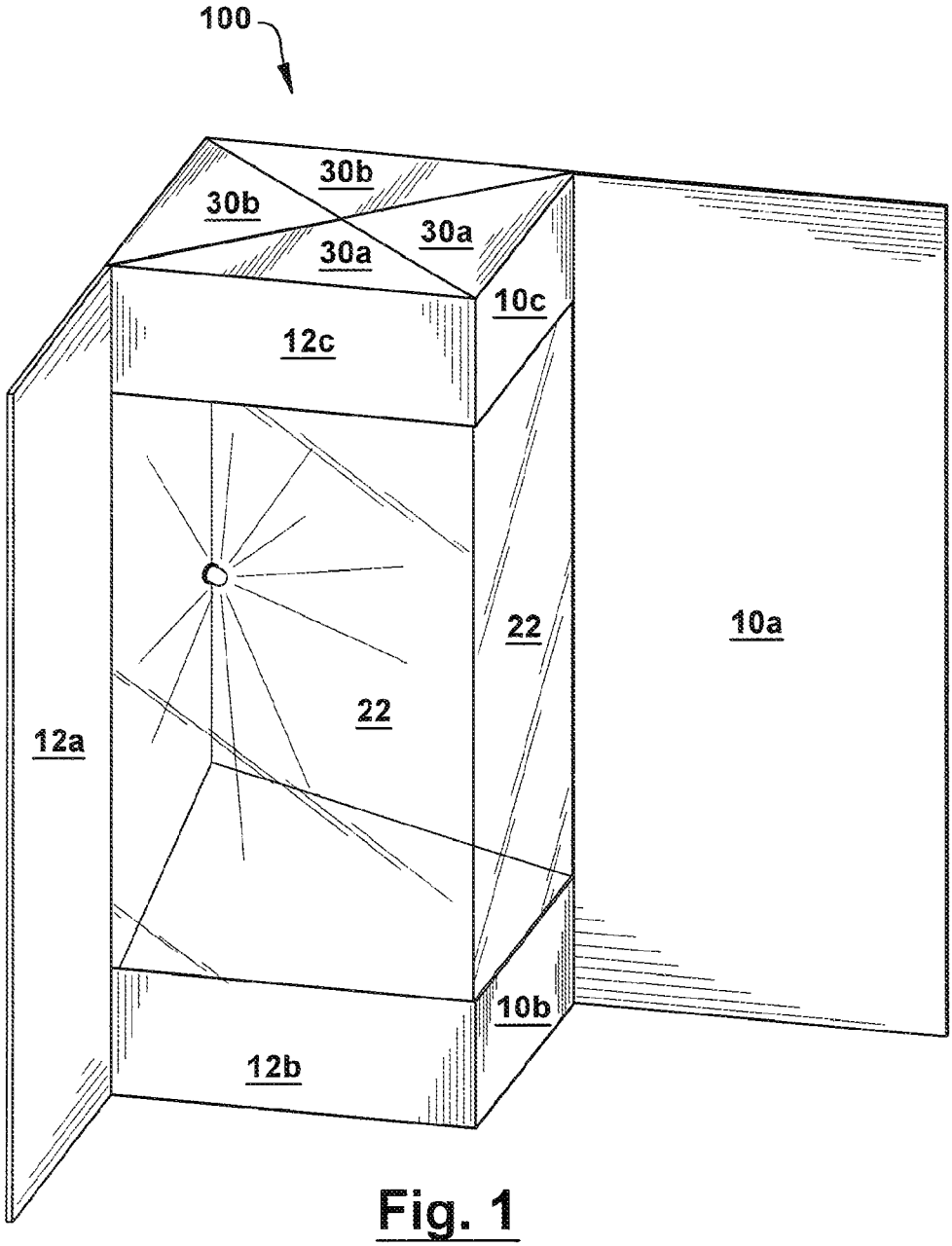
FIG. 1 is a perspective view of a representative embodiment of a 3D illuminated greeting card of the present invention.
Figure 2:
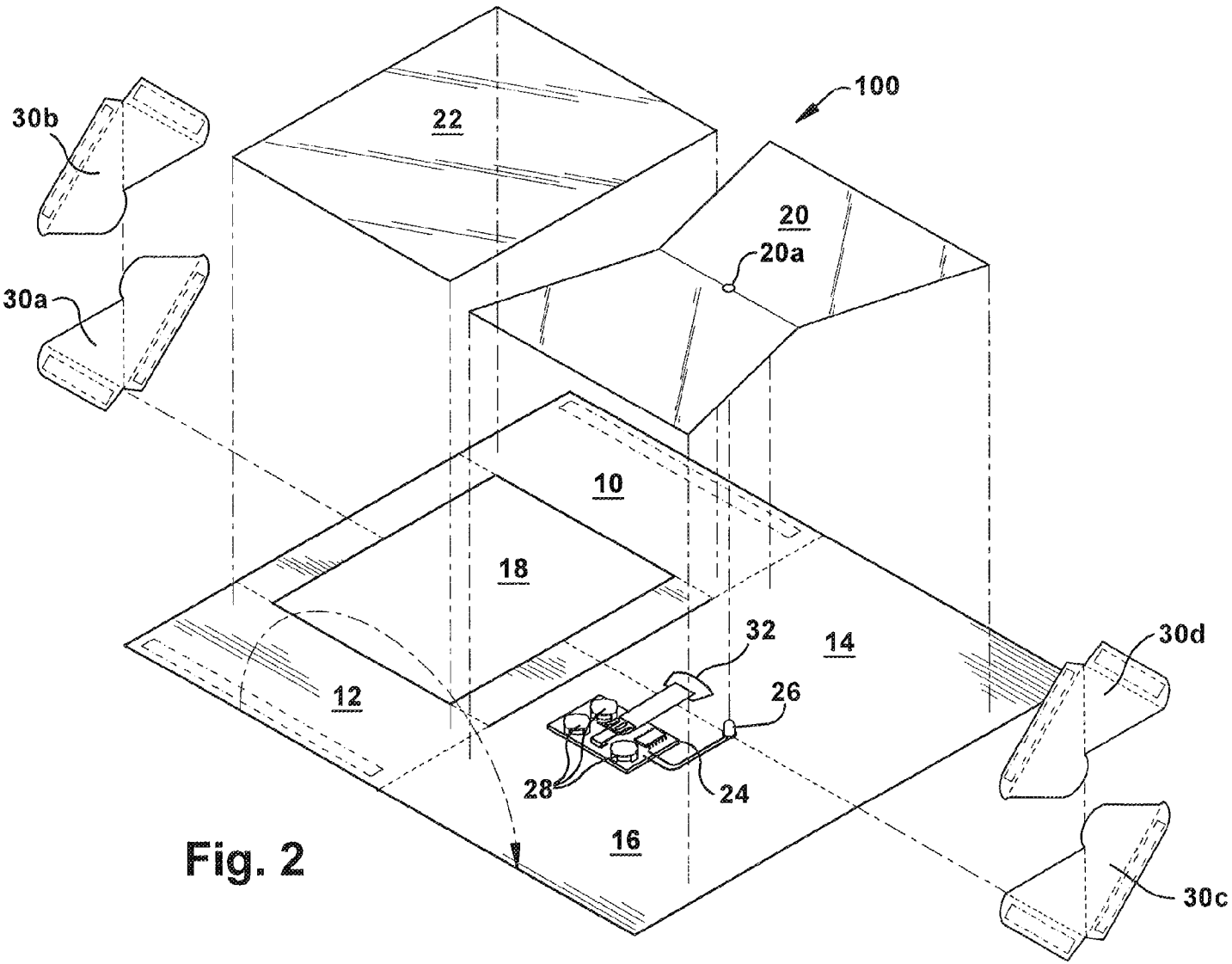
FIG. 2 is an exploded view of the 3D illuminated greeting card of FIG. 1.
Figure 6:
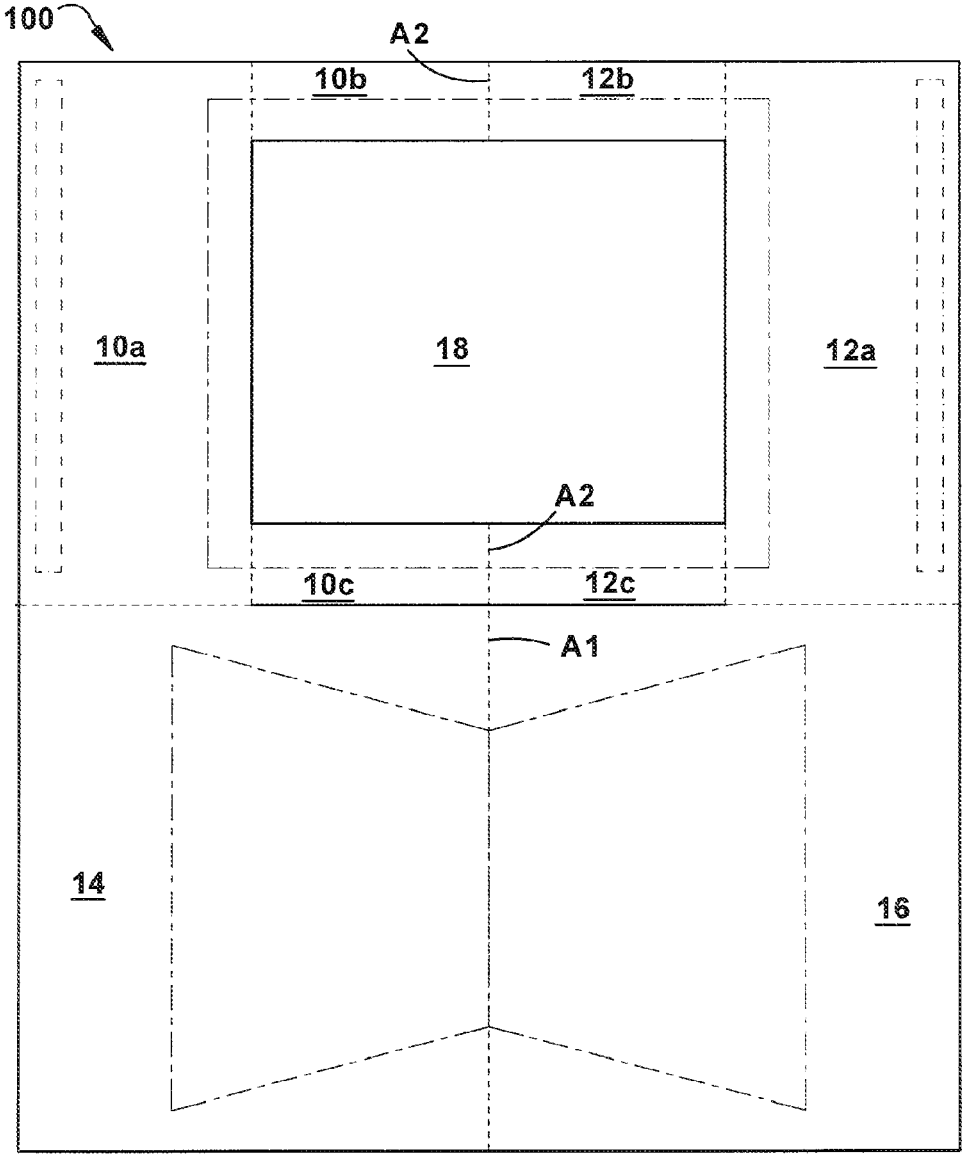
FIG. 6 is a die cut of the 3D illuminated greeting card of FIG. 1.
Figure 7:
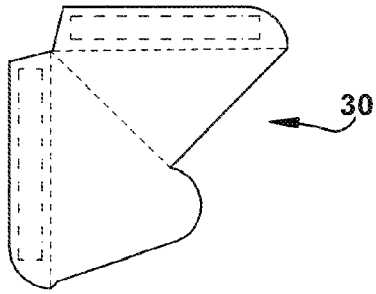
FIG. 7 is a top view of a representative interlocking tab.

A representative embodiment of the 3D illuminated greeting card is shown in FIG. 1. The card construction 100 includes multiple greeting card panels and tabs combined with a screen or filter panel 22 to form a square shaped cavity wherein electronic components are concealed, the square shaped cavity being contained between two main greeting card panels. A card key for this embodiment is shown in FIG. 6. The construct is a basic French fold having four sections or panels 10, 12, 14, 16, sections 14 and 16 being bisected vertically by a first fold line A1 and sections 10*b* and 12*b* and 10 and 12*c* being bisected vertically by fold line A2. Panels 10*a* and 14 are bisected horizontally by fold line B and panels 12*a* and 16 are bisected horizontally by fold line C. Panel 16 serves as the front outside cover of the greeting card and panel 14 serves as the back outside cover of the greeting card. Panels 10 and 12 are each divided into three sections (10*a*, 10*b*, 10*c* and 12*a*, 12*b*, 12*c*) with an opening 18, which extends between panels 10 and 12 across fold line A2 to accommodate a screen panel 22. While panels 10, 12, 14 and 16 are preferably made of paperboard or other stiff paper-like material, the screen panel 22 is made of acetate, tracing paper or other suitable translucent or semi-transparent material. Panels 14 and 16 are folded downward along horizontal fold lines B and C and positioned behind panels 10, 12 and opening 18. A portion of panels 14 and 16 are attached, adhesively or otherwise, to panels 10*a* and 12*a*. Interlocking tabs 30, shown in FIGS. 2 and 7, are used to create an enclosed cavity between panels 10*b*, 10*c*, 12*b*, 12*c*, 14 and 16. Interlocking tab 30*a* is attached to the top edge of panels 10*c* and 12*c*; interlocking tab 30*b* is attached to the top edge of panels 14 and 16; interlocking tab 30*c* is attached to the bottom edge of panels 10*b* and 12*b*; and interlocking tab 30*d* is attached to the bottom edge of panels 14 and 16. Each interlocking tab contains various strategic folds that allow the tabs to interlock when the greeting card is opened and the 3D structure is erected and to fold downward within the 3D structure when the greeting card is closed and the 3D structure is collapsed. When the greeting card is in a closed position (panels 14 and 16 moving toward each other along fold line A1 with fold lines A1 and A2 folding in opposing directions), panel 12*a* is in direct contact with 12*b*, 12*c* and a portion of screen panel 22, panel 10*a* is in direct contact with panels 10*b*, 10*c* and a portion of screen panel 22 and a portion of panel 14 is in direct contact with a portion of panel 16. When the greeting card is in an open position (panels 14 and 16 moving away from each other along fold line A1), panels 10*b*, 10*c*, 12*b*, 12*c* and screen panel 22 "pop-out" to form a substantially square shaped enclosed 3D structure.

A printed circuit board (PCB) 24 is attached, adhesively or otherwise, to the inside surface of the cavity formed within the 3D pop-out structure, preferably to panels 14 and/or 16. An integrated circuit (IC) chip contained within the PCB 24 is attached to one or more LED lights 26 used to illuminate the 3D structure. A sheet of reflective foil paper 20 or other such reflective material is placed over the back surface of the cavity (panels 14 and 16) over the PCB 24, as shown in FIG. 2. The one or more LED lights 26 are inserted through one or more apertures 20*a* in the reflective material 20 so that the light 26 can be cast off the reflective material 20. A screen panel 22 is placed over the opening or aperture 18 between panels 10 and 12. The screen panel 22 is made of acetate, tracing paper or other translucent or semi-transparent material and is used as a screen or filter though which the light 26 can be seen. The screen panel 22 may contain artwork, or printed text that is illuminated or backlit by the LED 26. The screen 22 may also contain a hidden word or design that is not clearly visible until the LED 26 is illuminated behind the screen 22. The material of the screen panel 22 also softens the light so that it appears as a soft glow. The electronics are powered by disposable batteries 28, such as one or more button cell batteries which are attached to the PCB 24. The IC chip may be programmed with various lighting effects, including but not limited to: blinking (repetitive on/off); twinkling (two or more lights with fast alternating blink); and slow glow (starts as dim light that progressively gets brighter). Different timing patterns may also be used with the various lighting effects.

Illumination of the one or more LED lights 26 contained with the 3D cavity can be controlled by a slide switch 32 upon opening the greeting card 100. The slide switch mechanism 32 may be located, for example, across fold line A1 such that when a user opens the greeting card 100 by moving panels 14 and 16 away from each other, the slide switch 32 closes the circuit and causes the light 26 to become illuminated. When the greeting card 100 is closed by moving panels 14 and 16 toward each other, the slide switch 32 breaks the circuit, thereby distinguishing the light 26. Alternatively, the activation of the light 26 may be controlled by other types of switches, such as a magnetic switch, a push button switch, a touch sensitive switch, a light sensitive switch or any other switch mechanism that can be easily attached to and concealed within the body of the greeting card and/or 3D cavity. For example, a push button switch or a touch sensitive switch can be used to control the illumination of the light or lights by requiring user interaction to turn the light or lights off and on. When the light or lights are automatically illuminated upon opening the greeting card, such as by a slide switch or a magnetic switch, the light may stay illuminated for a pre-set period of time such as, for example, 15 seconds, before automatically turning off. This enables the greeting card to be displayed in a fully open position without draining the battery.

Optionally, the 3D illuminated greeting card of the present disclosure and related inventions may contain additional electronic components which would enable the greeting card to play sound or music. The additional components may include a speaker and a memory device which may contain one or more pre-loaded digital audio files. The audio files may be played back upon opening the greeting card as described above with respect to a slide switch and illumination of the one or more lights contained within the greeting card. Both the audio playback and illumination of the light or lights can be controlled by a single switch, such as a slide switch, or they can be controlled by two separate switches. For example, the illumination of the one or more lights may be automatic upon a user opening the greeting card, wherein the slide switch closes the circuit allowing power to the lights, and the playback of one or more audio files may be initiated upon user interaction with a press-button switch. Any combination of switch types may be used to control illumination of the light or lights and playback of one or more digital audio files. To add a more personal touch, the greeting card may further include a microphone and a memory storage device capable of saving a user recorded message so that a user may record a personal message that is played back upon closing the circuit. A user recorded message can be used in combination with pre-loaded content such as a song, music or spoken word, wherein the user recorded message is played before, during or after playback of a pre-recorded digital audio file.

While the representative embodiment described herein contains a square or rectangular 3D structure, other embodiments may contain 3D structures having different sizes and/or shapes. For example, while the length 3D structure of the representative embodiment is equal to the length of the outer greeting card panels, other embodiments may be of a length that is less than that of the outer greeting card panels. Also, the representative embodiment is described as having a main vertical fold line between two main greeting card panels about which the greeting card is opened and closed. Other embodiments may have a horizontally disposed fold line along the top edge of the greeting card so that opening the greeting card requires the movement of the top panel in an upward direction away from the bottom panel. Alternative embodiments may contain more than one 3D structure, contained between multiple greeting card panels such as a tri-fold or accordion style greeting card. Any number of lights can be contained within the 3D structure and the lights may be white or clear or may colored lights in blue, red, green, etc. The lights contained within the cavity may all be the same color or may be different colors. The number of greeting card panels, the shape and size of the 3D pop-out structure, and the number and color of the lights may be varied and are considered to be within the scope of the present invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A greeting card comprising:

a greeting card body having a front panel and a back panel attached to the front panel along a fold line;

a three-dimensional structure contained between the front panel and the back panel of the greeting card body, the three-dimensional structure having a first panel and a second panel attached to the first panel along a fold line, a first pair of interlocking tabs wherein one tab is attached to a top edge of the first panel and the other tab is attached to a top edge of the second, and a second pair of interlocking tabs wherein one tab is attached to a bottom edge of the first panel and the other tab is attached to a bottom edge of the second panel;

one or more LED lights contained within the three-dimensional structure;

an integrated circuit chip which controls illumination of the one or more LED lights;

wherein when the greeting card body is in a closed position, the three-dimensional structure is collapsed and the one or more LED lights is off and when the greeting card body is in an open position, the three-dimensional structure is erected with the first and second pair of interlocking tabs creating a closed top and closed bottom surface and one or more LED lights is on, and wherein the one or more LED lights can be seen through the three-dimensional structure when the one or more LED lights is turned on.

2. The greeting card of claim 1, wherein a portion of the three-dimensional structure is made of a translucent material.

3. The greeting card of claim 1, wherein an outside surface of the three-dimensional structure contains hidden text or artwork that is revealed when the one or more LED lights is turned on.

4. The greeting card of claim 1 further comprising a slide switch which controls activation of the one or more LED lights.

5. The greeting card of claim 1 further comprising a push button switch which controls activation of the one or more LED lights.

6. The greeting card of claim 1, wherein the one or more LED lights are programmed to turn off after they have been on for a period of between 10 seconds and 20 seconds.

7. The greeting card of claim 1, wherein the three-dimensional structure forms an enclosed cavity when in an erect position.

8. The greeting card of claim 1, wherein the one or more LED lights are programmed to perform a light effect selected from the list of blinking, twinkling and slow glow.

* * * * *